US006634301B1

(12) United States Patent
Mulinix

(10) Patent No.: US 6,634,301 B1
(45) Date of Patent: Oct. 21, 2003

(54) ENCLOSED IGNITION FLARE IGNITER

(75) Inventor: David J. Mulinix, Bloomington, IN (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/263,283

(22) Filed: Sep. 26, 2002

(51) Int. Cl.[7] ..... F42C 15/34

(52) U.S. Cl. ..... 102/336; 102/229; 102/254; 102/256

(58) Field of Search ..... 102/336, 254, 102/256, 229

(56) References Cited

U.S. PATENT DOCUMENTS

| | | | | | |
|---|---|---|---|---|---|
| 3,313,236 | A | * | 4/1967 | Lohmann | 102/256 |
| 3,392,672 | A | | 7/1968 | Noles | 102/70 |
| 3,423,931 | A | | 1/1969 | Schwarz et al. | 60/39.47 |
| 3,479,954 | A | * | 11/1969 | Bolieau | 102/336 |
| 3,485,169 | A | * | 12/1969 | Lai | 102/336 |
| 3,529,418 | A | | 9/1970 | Puckett | 60/39.09 |
| 4,029,014 | A | | 6/1977 | Cunningham | 102/35 |
| 4,147,493 | A | | 4/1979 | Straitz | 431/15 |
| 4,155,306 | A | * | 5/1979 | Herold et al. | 102/336 |
| 4,307,665 | A | | 12/1981 | Block et al. | 102/505 |
| 4,406,227 | A | | 9/1983 | Beeker et al. | 102/505 |
| 4,573,411 | A | | 3/1986 | Leibhardt et al. | 102/256 |
| 4,599,945 | A | | 7/1986 | Groestra et al. | 102/256 |
| 4,679,503 | A | * | 7/1987 | Rudenauer et al. | 102/254 |
| 4,683,823 | A | | 8/1987 | Dinger et al. | 102/229 |
| H453 | H | | 4/1988 | Scmidlin | 102/221 |
| 4,899,659 | A | * | 2/1990 | Hardt | 102/251 |
| 5,033,383 | A | | 7/1991 | Edminster | 102/254 |
| 5,063,847 | A | | 11/1991 | Halsigg et al. | 102/271 |
| 5,454,322 | A | * | 10/1995 | Sakamoto et al. | 102/247 |
| 5,561,259 | A | | 10/1996 | Herbage et al. | 102/334 |
| H1603 | H | | 11/1996 | Deckard et al. | 102/336 |
| 6,170,399 | B1 | | 1/2001 | Nielson et al. | 102/336 |
| 6,389,976 | B1 | * | 5/2002 | Zacharin | 102/256 |

* cited by examiner

*Primary Examiner*—Peter A. Nelson
(74) *Attorney, Agent, or Firm*—Mark O. Glut

(57) ABSTRACT

An enclosed ignition flare igniter that includes a housing and two slider assemblies. The housing includes a first portion and a second portion. The two slider assemblies are disposed within the housing; each slider assembly has an armed position and a safe position. The armed position allows conflagrant communication between an ignition device and flare grain, while the safe position does not. Each slider assembly includes an ignition portal portion, a tab portion, and a spring. The ignition portal portion and the tab portion are juxtaposed. The ignition portal portion includes an ignition portal for holding an ignition device, while the tab portion includes a spring bore for accepting the spring.

15 Claims, 4 Drawing Sheets

ENCLOSED IGNITION FLARE IGNITER

STATEMENT OF GOVERNMENT INTEREST

The invention described herein may be manufactured and used by or for the Government of the United States of America for governmental purposes without payment of any royalties thereon or therefor.

BACKGROUND

The present invention relates to a flare igniter. More specifically, but without limitation, the present invention relates to an enclosed ignition flare igniter, specifically an enclosed ignition igniter for a kinematic aerial flare or an aerodynamically stabilized kinematic infrared countermeasure.

Aerial flares are used for a variety of applications, including, but not limited to, illumination, signaling, marking, decoys, military countermeasures, and the like. A flare is typically defined, but without limitation, as a pyrotechnic device designed to produce a luminous signal or illumination. Due to the important nature of their uses, aerial flares require a high degree of reliability in their ignition systems. The flare must not prematurely ignite, which can cause damage to the platform from which the flare is being released (a platform can be, for instance, but without limitation, a stand, an aircraft, a ship, a submarine, a land vehicle, and the like.) The flare must also have consistent ejection velocities.

The flare must be in a constant state of readiness, and when the flare ignition system is placed in the "armed" mode, ignition must be certain. Nevertheless, the flare cannot be carried on a vehicle or transported in an armed mode at all times. The flare must be capable of being transported with the ignition in a "safe" mode in which ignition is impossible.

In operation, typically a military flare or countermeasure is dispensed from a flare dispenser using an impulse cartridge. Upon initiation of the impulse cartridge, the flare payload (igniter/grain assembly) begins to move from the flare case. The hot particles from the impulse cartridge travel through a hole and ignite an ignition pellet. An interrupt or slider separates the pellet and flare grain (i.e. the illuminant or pyrotechnic material.) As the ignition system departs from the flare case the interrupt or slider is removed from between the ignition pellet and flare grain, allowing the flare grain to be ignited by the pellet, and thus illuminating the flare.

United States Navy decoy flares are now being initiated or ignited by several various different igniter designs. One is a pull wire ignition, which is being phased out due to safety concerns. The other design being currently used is a safe and arm type igniter as described in U.S. Statutory Invention Registration Number 1603, as well as similar type igniters. This igniter utilizes ignition pellets and a bore riding slider. When the impulse cartridge is fired to eject the payload of a decoy flare, hot gases from the cartridge ignite the ignition pellets. Before the flare grain/igniter assembly exits its case, ignition cannot take place due to a bore riding slider that separates the burning igniter pellets from the flare grain. However, each of these igniters, as well as other known igniters, suffers from one or more of the following disadvantages: the igniter does not adequately center the payload (or igniter) to prevent impulse cartridge gas blow by around the piston; at times the igniter causes unwanted premature grain ignitions; and causes inconsistent ejection velocity of the grain. In addition, currently used flares do not forcefully direct the flame from the ignition pellets to the flare grain. The top of the burning ignition pellet can exhaust to the atmosphere as well as through to the flare grain. This type of open ignition decreases ignition reliability.

For the foregoing reasons, there is a need for an enclosed ignition flare igniter.

SUMMARY

The instant invention is directed to an enclosed ignition flare igniter that satisfies the needs enumerated above and below.

The present invention is directed to an enclosed ignition flare igniter that includes a housing and two slider assemblies. The housing includes a first portion and a second portion. The two slider assemblies are disposed within the housing between the first portion and the second portion; each slider assembly has an armed position and a safe position. The armed position allows conflagrant communication between an ignition device and flare grain, while the safe position does not allow conflagrant communication between the ignition device and flare grain. Each slider assembly includes an ignition portal portion, a tab portion, and a spring. The ignition portal portion and the tab portion are juxtaposed. The ignition portal portion includes an ignition portal for holding an ignition device, while the tab portion includes a spring bore for accepting the spring. Both springs are axially aligned. The housing also includes corresponding housing apertures such that each tab portion of the two slider assemblies can pass through the housing apertures and equalize force on sides of the flare case inner wall when in the safe position and be in the armed position when the tab portions do not communicate with the flare case inner wall.

It is an object of the invention to provide an enclosed ignition flare igniter that prevents and minimizes premature ignition of a flare.

It is an object of the invention to provide an enclosed ignition flare igniter that adequately centers the payload/igniter to prevent impulse cartridge gas blow by around the piston.

It is an object of the invention to provide an enclosed ignition flare igniter that has consistent ejection velocities.

It is an object of the invention to provide an enclosed ignition flare igniter wherein enclosed ignition occurs.

It is an object of the invention to provide an enclosed ignition flare igniter wherein the igniter forcefully directs the flame from the ignition pellets to the flare grain.

It is an object of the invention to provide an enclosed ignition flare igniter that is efficient, simple and an inexpensive safe-arm device for a flare.

DRAWINGS

These and other features, aspects and advantages of the present invention will become better understood with reference to the following description and appended claims, and accompanying drawings wherein:

DESCRIPTION

Figure 1:
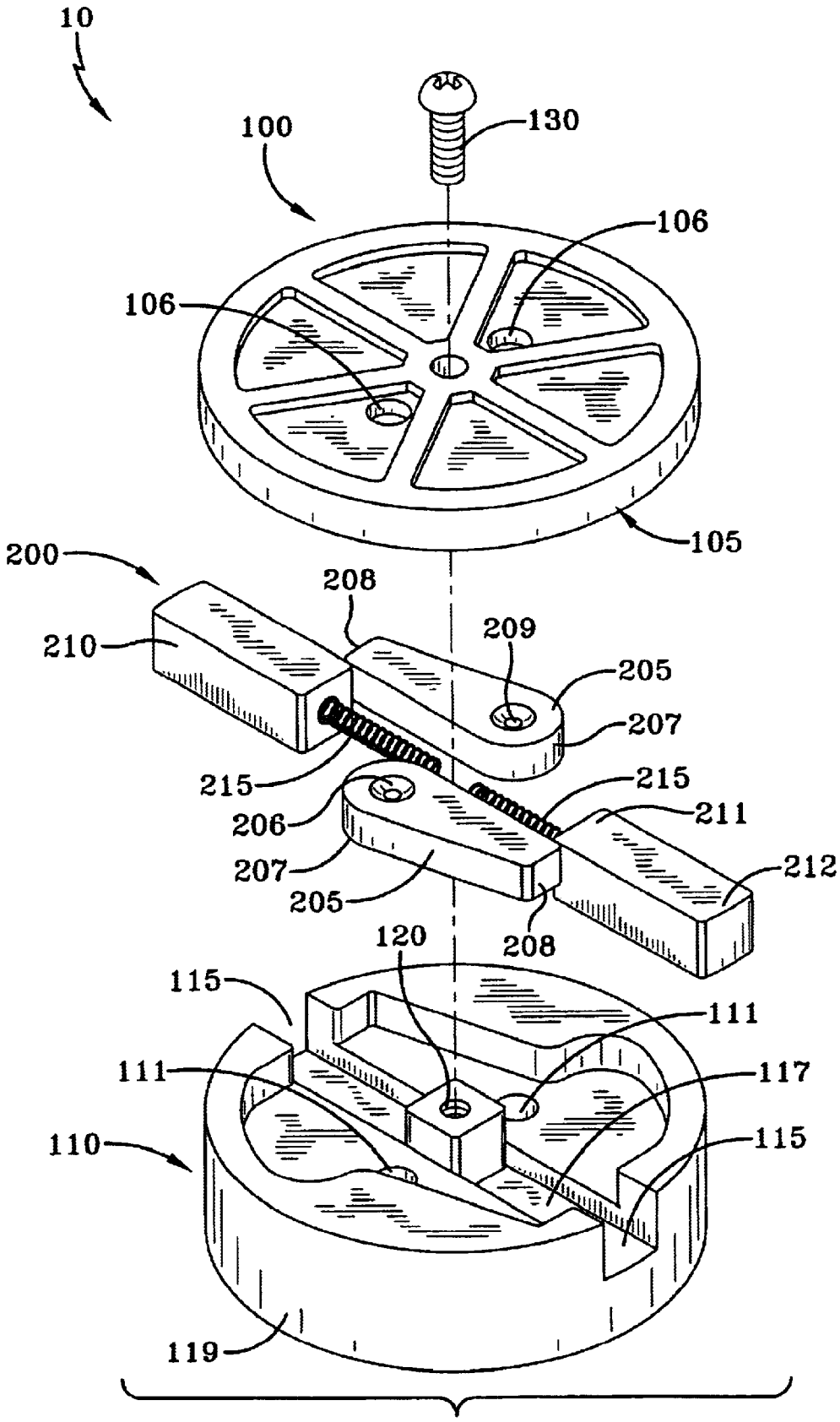
FIG. 1 is an exploded top view of one of the embodiments of the enclosed ignition flare igniter.

The preferred embodiment of the present invention is illustrated by way of example below and in FIGS. 1, 2A, 2B, 3A, 3B, 4, and 5. As seen in FIG. 1, the enclosed ignition flare igniter 10 includes a housing 100 and two slider assemblies 200. The housing 100 may have a first portion 105 and a second portion 110. The two slider assemblies 200 may be disposed within the housing 100 between the first portion 105 and the second portion 110. Each slider assembly 200 has an armed position and a safe position, the armed position allowing conflagrant communication between an ignition device and flare grain 510, the safe position not allowing conflagrant communication between the ignition device and flare grain 510.

As seen in FIG. 1, each slider assembly 200 may include an ignition portal portion 205, a tab portion 210, and a spring 215. The ignition portal portion 205 and the tab portion 210 may be juxtaposed.

The ignition portal portion 205 may include an ignition portal 206 for holding an ignition device. The ignition device may be an ignition pellet, or any type of device or means that can ignite flare grain 510. The ignition portal 206 may be a cup, an open container, a receptacle, or any type of article that lends itself to holding an ignition device. The ignition portal portion 205 may include a first ignition portal portion end 207 and a second ignition portal portion end 208. In the preferred embodiment, the first ignition portal portion end 207 is substantially circular, while the second ignition portal portion end 208 may be substantially triangular with a rounded corner.

In the preferred embodiment, the tab portion 210 of the slider assembly 200 is substantially rectangular. The tab portion 210 may be a slider or interrupt. The tab portion 210 may have a first tab portion end 211 and a second tab portion end 212. In the preferred embodiment, as seen in FIG. 1, the first tab portion end 211 is juxtapositioned to the second ignition portal portion end 208 on a side by side basis and the second tab portion end 212 is able to communicate with the inner flare case wall 513 of a flare 500. The tab portion 210 of the slider assembly 200, specifically the first tab portion end 211, may include a spring bore for accepting the spring 215. In the preferred embodiment, both springs 215 from the two slider assemblies 200 are axially aligned to each other, and each spring 215 is axially aligned to the tab portions 210. The housing 100, specifically the second portion 110, may have corresponding housing apertures 115 such that the second tab portion end 212 of each tab portion 210 can pass through the housing apertures 115 and equalize the force on sides of the flare case inner wall 513 when in the safe position, and be in the armed position when the second tab portion ends 212 do not communicate with flare case inner wall 513. The housing apertures 115 may be located on the second portion housing side wall 119.

Figure 2A:
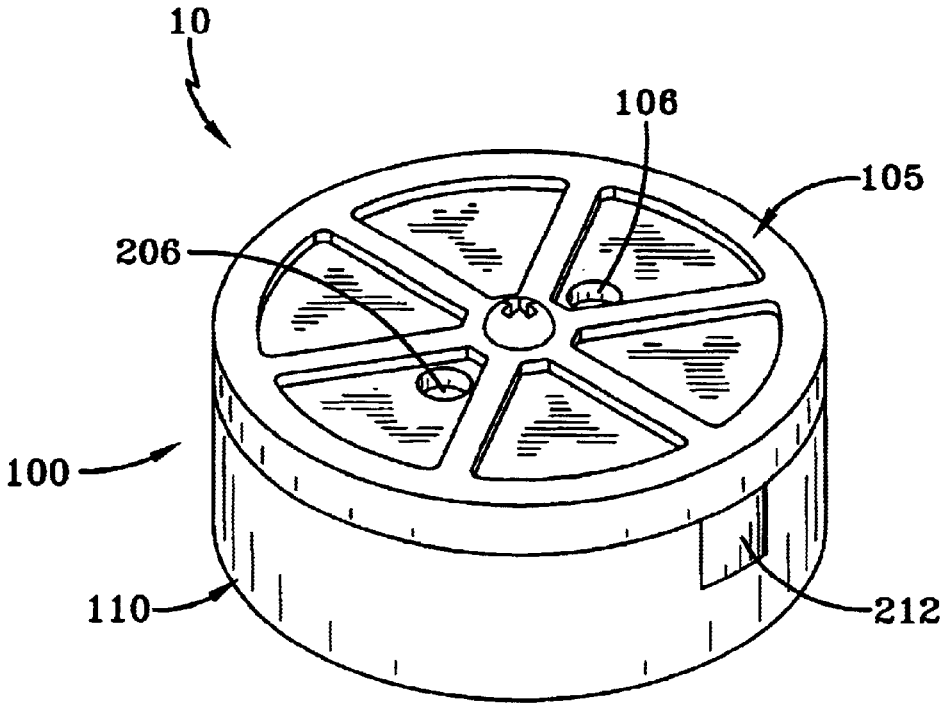
FIG. 2A is a top view of one of the embodiments of the enclosed ignition flare igniter in the safe position.
Figure 2B:
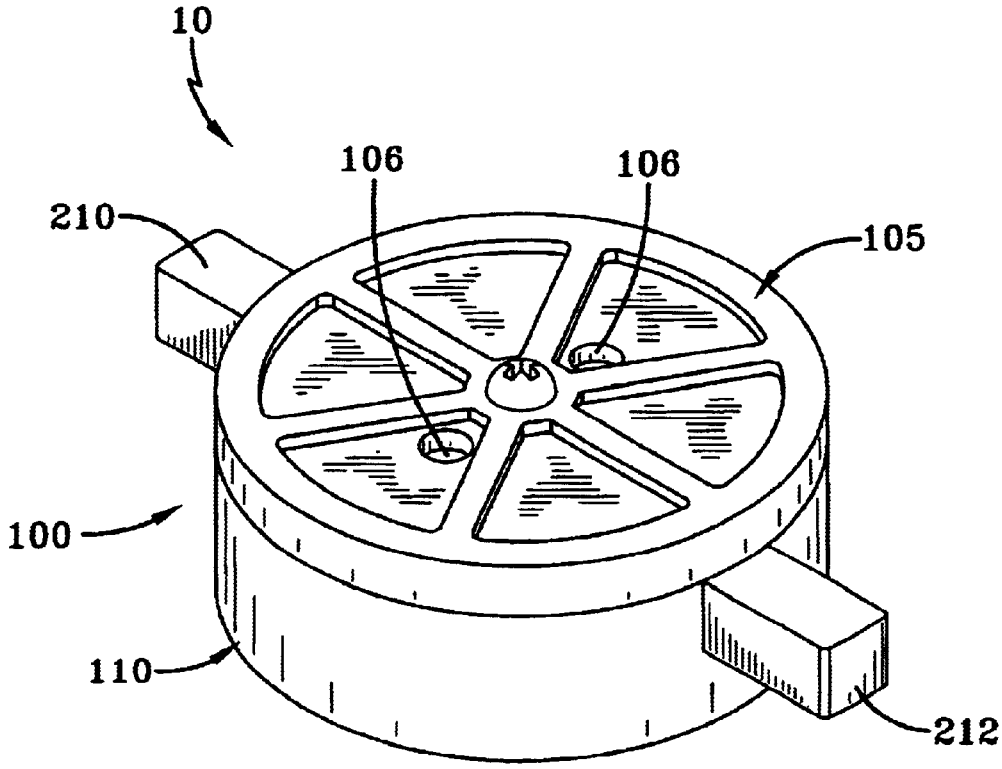
FIG. 2B is a top view of one of the embodiments of the enclosed ignition flare igniter in the armed position.
Figure 4:
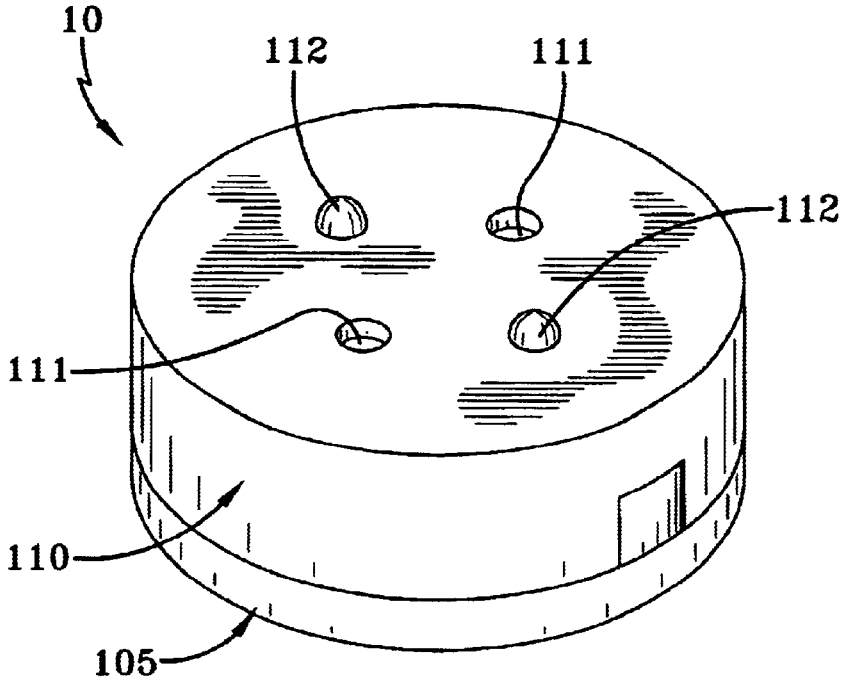
FIG. 4 is a bottom view of one of the embodiments of the enclosed ignition flare igniter.

The cross section of the housing 100 may be substantially circular and the housing 100 shaped in the form of a short cylinder, however, it may be any other shape. The housing 100 is typically similarly shaped to the flare cross section. As seen in FIG. 2A, the first portion 105 of the housing 100 may include first portion apertures 106 that correspond to the ignition device portals 206, when the igniter 10 is in the safe position. In the safe position there is conflagrant communication between the first portion apertures 106 and the ignition device portals 206 (specifically the ignition device). The ignition portal 206 may have an ignition portal aperture 209. As seen in FIG. 4, the second portion 110 of the housing 100 may include second portion apertures 111 that correspond to the ignition portal apertures 209 when the igniter is in the armed position. In the armed position, the second portion apertures 111 and the ignition portal apertures 209 correspond such there is conflagrant communication between the ignition device and the flare grain 510.

Figure 3A:
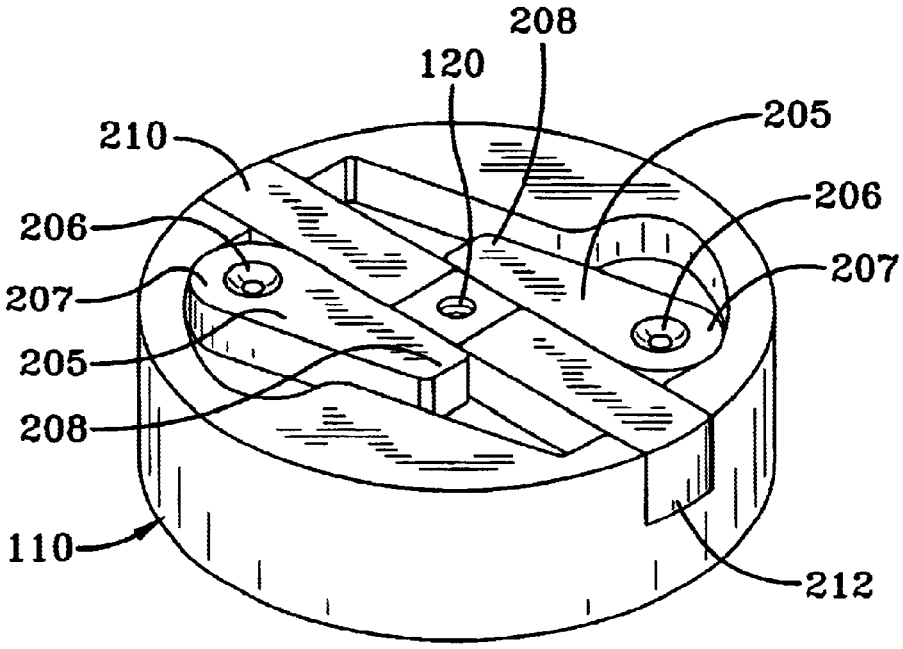
FIG. 3A is a top view of one of the embodiments of the enclosed ignition flare igniter with the first portion removed (the igniter being in the safe position)
Figure 3B:
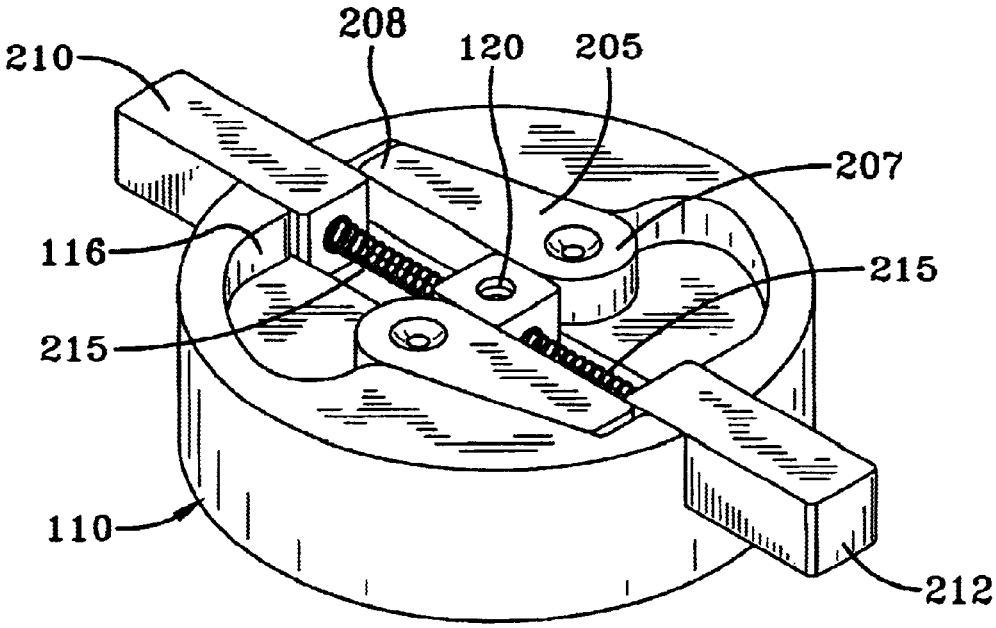
FIG. 3B is a top view of one of the embodiments of the enclosed ignition flare igniter with the first portion removed (the igniter being in the armed position)

As seen in FIGS. 1, 3A, and 3B, the housing 100 may include a housing column 120. The housing column 120 may substantially extend from the second portion 110 of the housing 100 to the first portion 105 of the housing 100, and be attached to the second portion 110 of the housing 100. The housing column 120 may be disposed within the housing 100 and may be substantially in the center of the housing 100. As seen in FIGS. 3A and 3B, the springs 215 may communicate with the housing 100 such that the housing column 120 is interposed between the springs 215. The housing 100, specifically the second portion 110, may also include a retaining wall 116. The retaining wall 116 may press against the first ignition portal portion end 207 in the safe position, and press against the second ignition portal portion end 208 in the armed position. The housing 100 may also include a spring-tab portion groove 117. The spring-tab portion groove 117 provides a path for the tab portion 210 and the spring 215.

The second portion 110 of the housing 100 may also include a housing projection 112. As seen in FIG. 4, the housing projection 112 may protrude or project out from the bottom of the second portion 110 of the housing 100, or on the opposite side of the second portion 110 where the slider assemblies 200 are located. The housing projection 112 may be dome shaped, conical, or any type of shape that lends itself to a projection or protrusion. In use, the bottom of the second portion 110 is typically in contact with flare grain 510 and may be stabilized by the housing projection 112, which presses into the flare grain 510. In addition, the housing projection may be used as an alignment feature to ensure the two igniter holes line up appropriately. The preferred amount of housing projections 112 is two; however, any number of housing projections 112 may be utilized.

The first portion 105 and second portion 110 of the housing may be attached to each other by any attachment means or method; however, an assembly screw 130 is the preferred attachment method. The assembly screw 130 may pass through the housing column 110.

Figure 5:
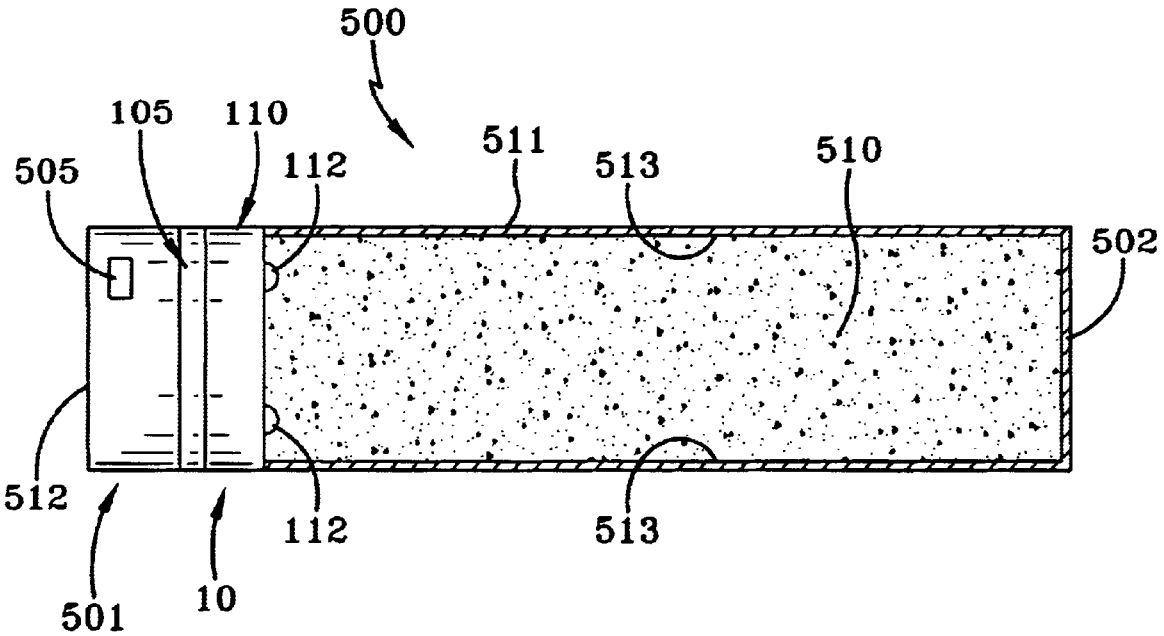
FIG. 5 is a side view of a flare with the enclosed ignition flare igniter.

A flare 500 with the enclosed ignition flare igniter 10 attached is shown in FIG. 5. In a flare ready for use, the second portion 110 of the housing is in communication with the flare grain 510. In operation, a flare 500 is dispensed from a flare dispenser using an impulse cartridge 505. The impulse cartridge 505 may be activated by percussion, an electrical current, or any other type of activation means or method. Upon activation of the impulse cartridge 505, the internal payload (the enclosed ignition flare igniter 10), which is typically located on the aft end 501 of the flare 500, begins to move from the flare case 511. As seen in FIG. 5, the impulse cartridge 505 is typically located behind enclosed ignition flare igniter 10 and has a casing 512 sealing the impulse cartridge 505 into place. When the impulse cartridge 505 is activated, and the igniter 10 is still in the safe mode and the first portion apertures 106 and ignition device portals 206 are aligned, the hot particles from the impulse cartridge 505 travel through the first portion apertures 106, to the ignition device portals 206 and ignite the ignition device (typically ignition pellets.) In the safe position the slider assemblies 200 do not allow conflagrant communication between the ignition device and flare grain 510 and the tab portions 210 of the slider assemblies 200 press against the flare case inner wall 513. The force of the hot particles from the impulse cartridge 505 then causes the enclosed ignition flare igniter 10 to depart or eject from the flare case 511. When the enclosed ignition flare igniter 10 clears the flare case 511, the tab portions 210 no longer press against the flare case inner wall 513, the springs 215 are no longer fully tensioned, and the slider assemblies 200 allow the ignition portal 206, specifically the ignition portal aperture 209, and the second portion apertures 111 to line up by the outward axial tension forces in the springs 215, allowing the flare grain 510 to be ignited by the ignition pellet (which was just previously activated by the impulse cartridge 505.) The flare 500 continues on its trajectory, while the igniter system for a flare 10 separates from flare 500 and falls away from the flare 500.

The igniter system 10, except the springs 215, may be manufactured from injection molded plastic. The springs 215 may be manufactured from any material that lends itself to use as a spring.

When introducing elements of the present invention or the preferred embodiment(s) thereof, the articles "a," "an," "the," and "said" are intended to mean there are one or more of the elements. The terms "comprising," "including," and "having" are intended to be inclusive and mean that there may be additional elements other than the listed elements.

Although the present invention has been described in considerable detail with reference to certain preferred versions thereof, other versions are possible. Therefore, the spirit and scope of the appended claims should not be limited to the description of the preferred versions contained herein.

What is claimed is:

1. An enclosed ignition flare igniter system, the flare having a flare case inner wall, the enclosed ignition flare igniter system comprising:

(a) a housing, the housing comprising a first portion and a second portion; and (b) two slider assemblies, the two slider assemblies disposed within the housing between the first portion and the second portion, each slider assembly having an armed position and a safe position, the armed position allowing conflagrant communication between an ignition device and flare grain, the safe position not allowing conflagrant communication between the ignition device and flare grain, each slider assembly comprising an ignition portal portion, a tab portion, and a spring, the ignition portal portion and the tab portion juxtaposed, the ignition portal portion comprising an ignition portal for holding the ignition device, the tab portion comprising a spring bore for accepting the spring, both springs being axially aligned, the housing further comprising corresponding housing apertures such that each tab portion of the two slider assemblies can pass through the housing apertures and equalize force on sides of the flare case inner wall when in the safe position and be in the armed position when the tab portions do not communicate with the flare case inner wall.

2. The igniter system for a flare of claim 1, wherein the housing further comprising a housing cross section and the housing cross section being substantially circular.

3. The igniter system for a flare of claim 2, wherein the ignition portal comprising an ignition portal aperture, the first portion of the housing comprising first portion apertures that correspond to the ignition portal aperture when the igniter is in the safe position.

4. The igniter system for a flare of claim 3, wherein the second portion of the housing comprising second portion apertures that correspond to the ignition portal apertures when the igniter is in the armed position.

5. The igniter system for a flare of claim 4, wherein the housing further comprising a housing column, the housing column substantially extending from the second portion of the housing to the first portion of the housing, the housing column disposed within the housing and substantially in the center of the housing, the springs communicating with the housing such that the housing column is interposed between the springs.

6. The igniter system for a flare of claim 5, wherein the igniter portal portion further comprising a first ignition portal portion end and a second ignition portal portion end, the first ignition portal portion end being substantially circular, the second ignition portal portion end being substantially triangular.

7. An enclosed ignition flare igniter system, the flare having a flare case inner wall, the enclosed ignition flare igniter system comprising:

(a) a housing, the housing comprising a first portion, a second portion, a housing column, and a cross section, the housing cross section being substantially circular, the housing column substantially extending from the second portion of the housing to the first portion of the housing, the housing column disposed within the housing and substantially in the center of the housing; and (b) two slider assemblies, the two slider assemblies disposed within the housing between the first portion and the second portion, each slider assembly having an armed position and a safe position, the armed position allowing conflagrant communication between an ignition device and flare grain, the safe position not allowing conflagrant communication between the ignition device and flare grain, each slider assembly comprising an ignition portal portion, a tab portion, and a spring, the ignition portal portion and the tab portion juxtaposed, the ignition portal portion comprising an ignition portal for holding an ignition device, the ignition portal comprising an ignition portal aperture, the first portion of the housing comprising first portion apertures that correspond to each ignition device portal when the igniter is in the safe position, the second portion of the housing comprising second portion apertures that correspond to the ignition portal apertures when the igniter is in the armed position, the tab portion comprising a spring bore for accepting the spring, both springs being axially aligned, the housing further comprising corresponding housing apertures such that each tab portion of the two slider assemblies can pass through the housing apertures and equalize force on sides of the flare case inner wall when in the safe position and be in the armed position when the tab portions do not communicate with the flare case inner wall, the springs communicating with the housing such that the housing column is interposed between the spring, the igniter portal portion further comprising a first ignition portal portion end and a second ignition portal portion end, the first ignition portal portion end being substantially circular, and the second ignition portal portion end being substantially triangular.

8. The igniter system for a flare of claim 7, wherein the tab portion being substantially rectangular, the tab portion comprising a first tab portion end and a second tab portion end, the first tab portion end juxtapositionally attached to the second ignition portal portion end on a side by side basis, the second tab portion end being able to communicate with the inner flare case wall.

9. The igniter system for a flare of claim 8, wherein second ignition portal portion end being substantially triangular with a rounded corner.

10. The igniter system for a flare of claim 9, wherein the igniter system, other than the springs, are manufactured from injection molded plastic.

11. The igniter system for a flare of claim 10, wherein the first portion and the second portion of the housing are attached by an assembly screw, the assembly screw passing through the housing column.

12. The igniter system for a flare of claim 11, the second portion of the housing further comprising a spring-tab portion groove that provides a path for the tab portion and the spring.

13. The igniter system for a flare of claim 12, wherein the second portion of the housing further comprising a retaining wall that presses against the first ignition portal portion end in the safe position, and presses against the second ignition portal portion end 208 in the armed position.

14. The igniter system for a flare of claim 13, wherein the ignition device is ignitable by an impulse cartridge, the impulse cartridge located next to the first portion of the housing, the impulse cartridge attached to the second portion via a casing.

15. The igniter system for a flare of claim 14, wherein the second portion further comprising a housing projection, the housing projection in physical contact with flair grain.

* * * * *